United States Patent [19]

Baugh

[11] 4,031,581

[45] June 28, 1977

[54] SUB-SEA ADJUSTABLE BUOY

[75] Inventor: Benton F. Baugh, Houston, TX

[73] Assignee: Vetco Offshore Industries, Inc.

[22] Filed: Mar. 29, 1976

[21] Appl. No.: 671,276

[52] U.S. Cl. ..... 9/8 R; 61/69 R

[51] Int. Cl.[2] ..... B63B 21/52

[58] Field of Search ..... 9/8 R, 316; 114/16 R, 114/16 E, 16.5, 16.7, 52–54; 244/97; 73/170 A; 102/14; 61/69 R, 69 A

[56] References Cited

UNITED STATES PATENTS

| | | | |
|---|---|---|---|
| 3,376,588 | 4/1968 | Berteaux et al. | 9/8 R |
| 3,473,337 | 10/1969 | Carter, Jr. | 61/69 R |

*Primary Examiner*—Trygve M. Blix
*Assistant Examiner*—Douglas C. Butler
*Attorney, Agent, or Firm*—Pravel, Wilson & Gambrell

[57] ABSTRACT

A buoy having a controllable buoyancy and being particularly adapted for subsea use. The buoy includes an upper buoyant chamber member mounted with a lower chamber member. The lower chamber member has a lower chamber formed in it for containing variable amounts of a fluid which is buoyant in water and for containing variable amounts of water. The lower chamber member additionally has an opening formed in its bottom to permit water to pass into and out of the lower chamber and fill the portion of the lower chamber which is not occupied by the buoyant fluid. A control assembly operably connected to the lower chamber regulates the amounts of buoyant fluid in the lower chamber so that the buoyancy of the buoy is controlled.

3 Claims, 1 Drawing Figure

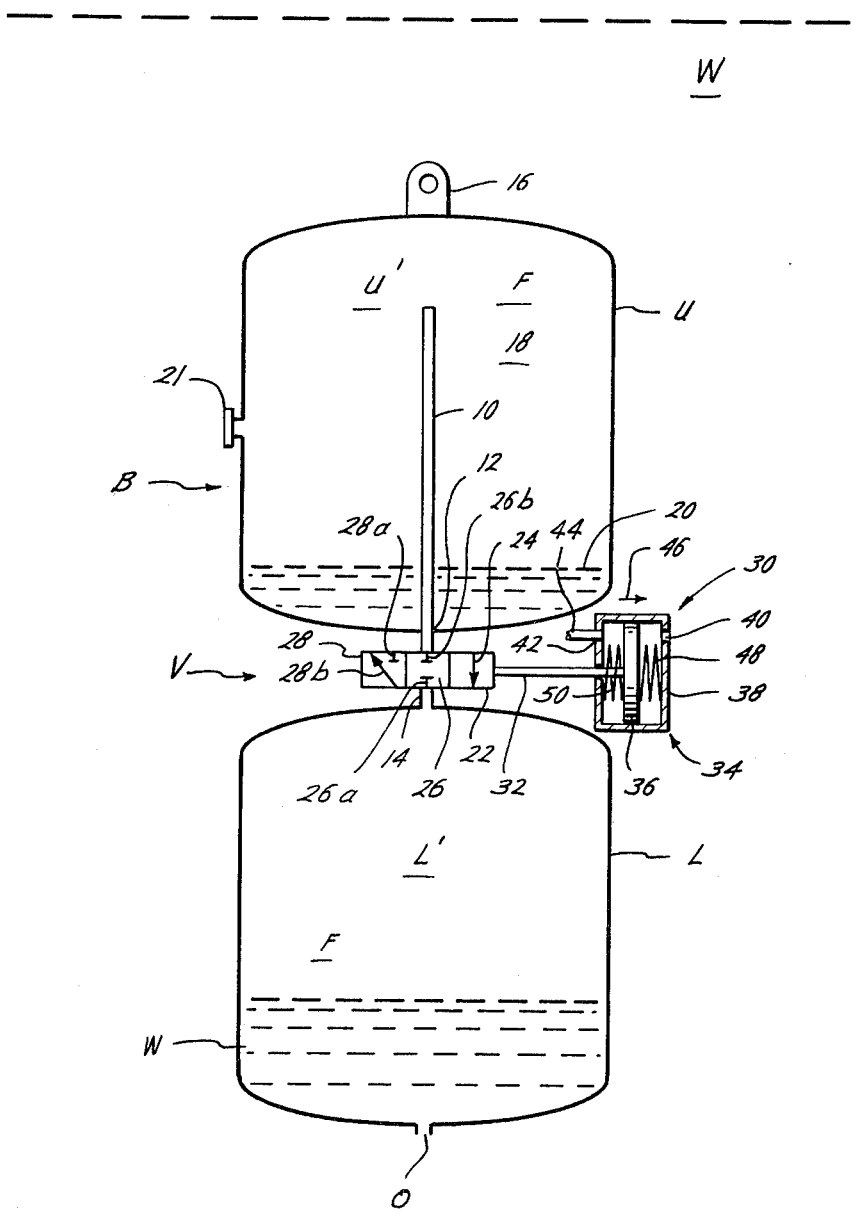
W
16
U'
F
U
18
21
10
12
B
26b
20
28a
24
44
46
30
40
28
42
48
V
28b
50
38
14
22
34
26a
26
32
36
L'
L
F
W
O

SUB-SEA ADJUSTABLE BUOY

BACKGROUND OF THE INVENTION

The field of this invention is buoys and the like.

In offshore drilling and production operations it is often desirable to transport equipment to an offshore location without actually loading the equipment on board a ship or other vessel. This is particularly true where flowlines are to be transported to an offshore well.

However, problems were encountered when the transported equipment was merely floated at or near the ocean surface using conventional buoys or the like. Often rough seas were encountered during the transportation of the equipment, and the wave action created forces which damaged or destroyed the transported equipment. Even where the equipment was suspended slightly below the ocean surface and supported by buoys which floated at the surface, the forces of the wave action on these surface buoys were transmitted to the transported equipment unless special assemblies were employed to absorb such wave action forces.

When the transported equipment had to be lowered to the ocean bottom after arriving at the offshore location, additional problems were encountered with the use of conventional surface buoys. Typically, such buoys would only support the transported equipment at or near the ocean surface. If the transported equipment was disengaged from the buoys, it simply fell to the ocean floor. Where the transported equipment was a flowline, this method of lowering the flowlines to the ocean bottom often resulted in kinking the flowlines and otherwise damaging them. Similarly, other equipment was often damaged if it was merely allowed to fall to the ocean bottom. While one tool was developed for use in conjunction with surface buoys so that the equipment being lowered would fall slowly through the water, a great deal of care had to be exercised in utilizing this tool.

SUMMARY OF THE INVENTION

It is an object of this invention to provide a new and improved buoy.

The buoy of the present invention includes an upper buoyant chamber member and a lower chamber member. The lower chamber member has a lower chamber formed in it for containing variable amounts of a fluid which is buoyant in water and for containing variable amounts of water. The lower chamber member additionally has an opening formed in its bottom to permit water to pass into and out of the lower chamber so that water fills the portion of the lower chamber which is not occupied by the buoyant fluid. A control means operably connected to the lower chamber regulates the amount of buoyant fluid in the lower chamber so that the buoyancy of the buoy in water is controlled.

Preferably, the upper chamber member has an upper chamber formed in it for containing the buoyant fluid under pressure. When it is desired to increase the buoyancy of the buoy, the control means controllably passes gaseous buoyant fluid from the upper chamber into the lower chamber. The buoyant fluid so introduced into the lower chamber displaces some of the water in the lower chamber, causing water to be expelled through the opening in the bottom of the lower chamber member. In this manner, the non-buoyant water in the lower chamber is replaced by the buoyant fluid so that the buoyancy of the buoy is increased.

Preferably, the buoyant fluid contained in the upper chamber member is substantially at equilibrium between its gaseous and liquid phases. The control means passes a portion of the gaseous buoyant fluid to the lower chamber when the lower chamber is charged to increase the buoyancy of the buoy. The withdrawal of a portion of the gaseous buoyant fluid from the upper chamber member temporarily reduces the pressure in the upper chamber member. However, the liquid phase of the buoyant fluid in the upper chamber vaporizes during the temporary reduction in the pressure of the upper chamber and substantially restores the equilibrium state of the buoyant fluid in the upper chamber. In this manner a sufficient supply of gaseous buoyant fluid at a suitable pressure is maintained in the upper chamber for successive charging of the lower chamber. Once the supply of buoyant fluid in the upper chamber has been depleted to a level at which it will no longer restore itself to equilibrium, the upper buoyant chamber may be recharged with additional buoyant fluid for subsequent use.

To decrease the buoyancy of the buoy, the control means vents at least some of the buoyant fluid in the lower chamber. As the buoyant fluid is vented from the lower chamber, water flows through the opening in the bottom of the lower chamber so that water occupies the volume of the lower chamber which was previously occupied by the vented buoyant fluid. As a result of the venting, the buoyant fluid in the lower chamber is replaced by non-buoyant water and the overall buoyancy of the buoy decreases.

The control means additionally includes an operator means by which the functioning of the control means may be regulated to increase or decrease the buoyancy of the buoy as desired. An actuator valve means in the control means may be provided with both a control pressure signal and a pressure signal equal to the ambient pressure of the water in which the buoy is located. The actuator valve means then regulates the charging and venting of the lower chamber in response to the differential between the pressure control signal and the ambient pressure of the water. By choosing one or more appropriate control pressures, the buoyancy of the buoy of the present invention may be controlled so that the buoy and any attached equipment are positioned at any of a plurality of selected depths in the ocean. For example, the buoyancy may be initially adjusted so that the buoy and transported equipment are at a desired depth for transportation of the equipment to an offshore location. Such a depth can be a sufficient distance beneath the ocean surface so that the wave action of the surface of the ocean does not damage either the buoy or the transported equipment. Once the buoy and equipment are on location, the buoyancy of the buoy may be decreased so that the equipment is slowly and safely lowered to the ocean bottom without damage to the equipment. Further, with suitable equipment attached to the buoy, the buoyancy of the buoy may be increased after the equipment has been positioned on the ocean bottom so that the buoy and equipment may be returned to the ocean surface.

BRIEF DESCRIPTION OF THE DRAWING

FIG. 1 is a schematic representation of the buoy of the present invention.

DETAILED DESCRIPTION OF THE PREFERRED EMBODIMENT

In the drawing, the letter B designates generally the buoy of the present invention which is employed in a body of water W or other suitable fluid medium. The buoy includes an upper buoyant chamber member U and a lower chamber member L mounted with the upper chamber member. The lower chamber member L has a lower chamber L′ formed in it for containing variable amounts of a buoyant fluid designated generally by F and for containing variable amounts of water W. The lower chamber member L additionally has an opening O formed in the bottom of the lower chamber member L to permit water W to pass into and out of the lower chamber L′. The water W in the lower chamber L′ fills the portion of the lower chamber L′ which is not occupied by the buoyant fluid F. A control means V operably connected to the lower chamber L′ regulates the amount of buoyant fluid F and, consequently, the amount of water W in the lower chamber L′ so that the buoyancy of the buoy B in water is controlled.

Considering the invention in more detail, the upper chamber member U has an upper chamber U′ formed in it to contain a buoyant fluid F. A conduit 10 extends into the upper chamber U′ and is joined to the upper chamber member U at the bottom 12 of the upper chamber member. The conduit is affixed to the bottom 12 of the upper chamber member U by welding or other suitable means to form a fluid tight seal between the outer periphery of the conduit 10 and the upper chamber member. The conduit 10 extends downwardly through the bottom 12 of the upper chamber member U and into fluid communication with a control valve V. A neck 14 of the lower chamber member L extends upwardly from the body of the chamber member to the control valve V. The neck 14, which may be integrally formed with the lower chamber member L, has a fluid passageway therethrough which permits fluid communication between the lower chamber L′ and the control valve V.

The control valve V is thus mounted with the upper chamber member U through conduit 10 and to the lower chamber member L at neck 14. Suitable conventional couplings (not shown) or other mounting means may be employed to mount the control valve with conduit 10 and neck 14. Such couplings which may be supplemented with additional mounting structures, if desired, preferably secure the upper chamber member U, the control valve V, and the lower chamber member L against movement relative to one another. In this manner, the buoy B forms a substantially unitary body. Further, a lifting lug 16 which may be integrally formed with the upper chamber member U or welded thereto can be provided for lifting the buoy B or otherwise positioning the buoy.

The control valve V may be any conventional three position valve and is, therefore, schematically illustrated in the drawing. The valve V is in fluid communication with the upper chamber U′ and the lower chamber L′ and controls fluid communication between these two chambers as well as allowing venting of the lower chamber L′. By suitably actuating the control valve V, the buoyancy of the buoy B may be increased, decreased, or maintained substantially constant.

In the preferred embodiment of the present invention, buoyant fluid F is contained in the upper chamber U′ at suitable temperatures and pressures so that the fluid F in the upper chamber U′ is substantially at equilibrium between its gaseous phase indicated generally by the numeral 18 and its liquid phase indicated generally by the numeral 20. The upper chamber member U contains the fluid in the upper chamber except when the control valve V allows some of the gaseous buoyant fluid 18 to pass through conduit 10 and neck 14 into lower chamber L′ to charge the lower chamber as explained in more detail hereinbelow. An example of the buoyant fluid suitable for use in the buoy B is nitrogen. The nitrogen may be placed in the upper chamber U′ through a sealable port 21 at a pressure in the range of 2,500 psi. At this pressure and at a suitable range of temperatures normally encountered during the operation of the buoy, the nitrogen will maintain itself in the equilibrium state between its gaseous and liquid phases. The upper chamber member U may, of course, be insulated to maintain the temperature in upper chamber U′ within acceptable temperature ranges.

When a portion of the gaseous nitrogen 18 is drawn out of the upper chamber U′, a slight, temporary pressure drop occurs in the upper chamber member U. However, this slight pressure drop causes a portion of the liquid nitrogen 20 to vaporize and restore the equilibrium state of the nitrogen. This both maintains the pressure of the fluid F in the upper chamber member U and provides a sufficient supply of gas for successive recharging of the lower chamber L′. Of course, the nitrogen will eventually be depleted through the successive chargings of the lower chamber. When there is an insufficient amount of nitrogen remaining in the upper chamber U′ for restoration of the equilibrium state of the fluid in the upper chamber, the upper chamber member U may simply be recharged by introducing an additional supply of nitrogen through port 21. However, by providing the buoyant fluid F in the upper chamber U′ at its equilibrium state, several successive chargings of the lower chamber L′ are possible without having to replenish the supply of the buoyant fluid F in the upper chamber U′.

The fluid F in the upper chamber member U gives the upper chamber member U a positive buoyancy. Further, due to the equilibrium state of the fluid F, the buoyancy of the upper chamber member U is relatively constant so long as a sufficient supply of the fluid F remains in the upper chamber member U. In the operation of the buoy B, the overall buoyancy of the buoy B is controlled by regulating the buoyancy of the lower chamber member L.

Control of the buoyancy of the lower chamber L′ is accomplished through the control means V. A charging means 22 in the valve V is controlled so that when it is desired to increase the buoyancy of the lower chamber member L, a fluid passageway indicated generally by 24 is operably connected between conduit 10 and neck 14. Since the pressure of the fluid F in the upper chamber U′ is greater than the ambient pressure of the water in which the buoy B is employed, the fluid F in its gaseous state 18 flows through the conduit 10, passageway 24, neck 14 and into lower chamber L′ to displace some of the water W in the lower chamber L′ through the opening O in the lower chamber member L. Thus, some of the non-buoyant water W in the lower chamber L′ is replaced by buoyant fluid F. This, of course, increases the buoyancy of the lower chamber member L and the buoyancy of the buoy B.

When it is desired to maintain the buoy B at some previously established level of buoyancy, a blocking means 26 of the control valve V prevents any fluid from flowing from the upper chamber U′ or the lower chamber L′. A first blocking port 26*a* blocks all the fluid flow through neck 14, and a second blocking port 26*b* blocks all fluid flow through conduit 10. By preventing fluid flow from either of the chambers U′ and L′, the buoyancy of the buoy B is maintained constant.

To reduce the buoyancy of the buoy B, the control valve V additionally includes a venting means 28. When the venting means is employed, a blocking port 28*a* blocks all fluid flow through the conduit 10. However, a venting passageway 28*b* is in fluid communication with neck 14 and allows at least some of the buoyant fluid F to flow out of the lower chamber L′ and into the water W exterior to the buoy B. As the buoyant fluid F is bled from the lower chamber L′ through neck 14 and venting passageway 28*b*, water W flows into the lower chamber L′ through opening O. The water is forced into the lower chamber L′ through the opening O due to the ambient pressure of the water W in which the buoy B is employed. Thus, with the use of the venting means 28, buoyant fluid F is permitted to escape from the lower chamber L′ and is replaced by non-buoyant water W. This replacement of the buoyant fluid F with non-buoyant water W decreases the buoyancy of the lower chamber L′ and the buoy B.

The control valve V is movable between three positions by an operator means 30. While any suitable conventional means may be utilized to selectively actuate the control valve V to a desired one of the control valve's three positions, the operator means 30 illustrated in the drawing includes a spring biased operator valve 34 connected to the control valve V by an actuator arm or shaft 32. The operator valve 34 has a housing 38 in which the diaphragm 36 is positioned for longitudinal movement. The shaft 32 is preferably fixed to the diaphragm 36 and extends to the control valve V to move the control valve V between its various positions in response to the movement of the diaphragm 36. The valve housing 38 is provided with a first port 40 which permits water W to flow into the valve 34 and exert on one side of the diaphragm 36 a pressure equal to the ambient water pressure. A second port 42 is provided on an opposing side of the valve body 38 to transmit a controlled pressure to the opposite side of the diaphragm 36. The diaphragm 36 moves in response to the differential in the pressure between the ambient water pressure provided through port 40 and the control pressure provided through port 42. The control pressure port 42 provides a means by which a control pressure can be utilized to position or maintain the buoy B at a desired depth. A control pressure signal line 44 may be connected to the port 42 to provide a passageway for conveying the desired control pressure to one side of the diaphragm. The control signal line 44 may extend to a surface unit (not shown) to provide a variable control pressure to the operator valve 34. Alternatively, a self-contained pressure unit may be affixed directly to the port 42 to provide a constant control pressure. In either case, the control pressure is selected to equal the ambient water pressure at the desired depth for the buoy B. When the water pressure sensed through port 40 is less than the water pressure which should be present at the desired depth, the control pressure exerted on the diaphragm 36 through port 42 is greater than the ambient water pressure sensed through port 40. Accordingly, the diaphragm 36 moves in the direction of arrow 46 and shaft 32 moves control valve V to its venting position. As explained above, this reduces the buoyancy of the buoy B and causes the buoy to sink to a greater depth. On the other hand, if the ambient water pressure provided through port 40 exceeds the control pressure, indicating that the buoy is at a depth greater than that desired, the diaphragm 36 moves in a direction opposite arrow 46, and shaft 32 moves control valve V to its charging position. In this position, the buoyancy of the buoy B is increased so that the buoy rises in the water W to a desired depth. If the pressures through port 40 and 42 are substantially equal, indicating the buoy is at the desired depth, the diaphragm 36 is positioned substantially in the center of the valve body 38 and the control valve V is moved to and maintained at the blocking position in which the buoyancy of the buoy B is maintained constant. A pair of biasing springs 48 and 50 are provided on opposing sides of the diaphragm 36 to ensure that the diaphragm will be properly positioned to return and maintain the control valve V in its blocking position when the control pressure equals the ambient water pressure. The forces exerted by biasing springs 48 and 50 are preferably small relative to the pressures exerted through ports 40 and 42 so that the biasing springs do not interfere with the movement of the diaphragm 36 in response to a differential between the pressure exerted through those ports. Additionally, the biasing forces of the springs 48 and 50 offset one another when the diaphragm 36 is in the central position for maintaining the control valve V in its blocking position.

As can be understood from the above description of the buoy B, the controllable buoyancy of the buoy provides many advantages over conventional buoys. Simply by providing control signals through port 42 at a pressure equal to the ambient pressure of the water at a desired depth, the buoy B may be positioned at any of a plurality of depths. This is particularly advantageous when the buoy B is used in offshore drilling and production operations. The buoy may be attached by any suitable means (not shown) to equipment to be transported to an offshore well location. Initially, the buoy may be set to maintain depth below the ocean surface which is suitable for transporting the equipment without sustaining any damage from surface wave action. Of course, a plurality of buoys B may be employed together with each receiving the same control signals so that they each attain approximately the same depth. This is particularly advantageous when the equipment being transported is a flow-line for use at an offshore well location. Once the equipment reaches the offshore well location, the buoys may be adjusted to a different depth, if desired, to permit maintenance or initial installation operations on the equipment. If it is desired to lower the equipment to the ocean bottom, this may be accomplished without any damage to the equipment simply by providing an appropriate control signal to the operator valve 34 causing the buoy B to slowly descend to the ocean floor. Subsequently, the equipment may even be retrieved from the ocean bottom by increasing the buoyancy of the buoys B with another appropriate control signal. Thus, it can be seen that the buoy of the present invention provides an extremely useful tool which can significantly reduce expenditures of time, money and manpower in offshore drilling and production operation.

The foregoing disclosure and description of the invention are illustrative and explanatory thereof, and various changes in the size, shape, and materials as well as in the details of the illustrated construction may be made without departing from the spirit of the invention. For example, the buoyant chamber member U has been described as being mounted above chamber member L when the buoy B is in its normal operating position illustrated in the drawing. Alternatively, however, the buoyant chamber member U and chamber member L could be mounted in reversed positions so that the buoyant chamber member U is beneath chamber member L with the buoy B in its normal operating position.

I claim:

1. A buoy having a controllable buoyancy in water, comprising:

a first chamber member;

a second, buoyant chamber member mounted with said first chamber member;

said first chamber member having a first chamber therein for containing variable amounts of a fluid which is buoyant in water and for containing variable amounts of water;

said first chamber member having an opening formed in its bottom to permit water to pass into and out of said first chamber and fill the portion of said first chamber which is not occupied by buoyant fluid;

control means operably connected to said first chamber for regulating the amount of buoyant fluid in said first chamber so that the buoyancy of the buoy in water is controlled;

said second chamber member has a second chamber therein for containing buoyant fluid under pressure;

said control means is operably connected to said second chamber and said first chamber; and said control means includes control valve means for controllable movement between a charging position in which buoyant fluid is conveyed from said second chamber to said first chamber, a blocking position in which buoyant fluid is prevented from escaping from said first and second chambers, and a venting position in which buoyant fluid is vented from said first chamber.

2. The structure set forth in claim 1, wherein said control means further includes:

operator means for controlling the movement of said control valve means between said charging, blocking and venting positions.

3. The structure set forth in claim 2, wherein said operator means is provided with a control pressure and the ambient pressure of the water in which said buoy is utilized, and said operator means includes:

operator valve means for controlling the movement of said control valve means in response to the pressure differential between the control pressure and the ambient water pressure.

* * * * *